US008434899B2

(12) United States Patent
Lee et al.

(10) Patent No.: US 8,434,899 B2
(45) Date of Patent: May 7, 2013

(54) LED LIGHTING APPARATUS HAVING BLOCK ASSEMBLING STRUCTURE

(75) Inventors: Jae Yeong Lee, Seoul (KR); Sang Dong Jeong, Incheon (KR)

(73) Assignee: Amoluxe Co., Ltd. (KR)

( * ) Notice: Subject to any disclaimer, the term of this patent is extended or adjusted under 35 U.S.C. 154(b) by 0 days.

(21) Appl. No.: 13/434,250

(22) Filed: Mar. 29, 2012

(65) Prior Publication Data

US 2012/0206918 A1 Aug. 16, 2012

Related U.S. Application Data

(63) Continuation-in-part of application No. PCT/KR2010/006403, filed on Sep. 17, 2010.

(30) Foreign Application Priority Data

Sep. 30, 2009 (KR) ..... 10-2009-0092790

(51) Int. Cl.
*F21S 4/00* (2006.01)
*F21V 21/00* (2006.01)

(52) U.S. Cl.
USPC ..... 362/249.02; 362/294; 362/373; 362/431; 362/800

(58) Field of Classification Search ..... 362/249.02, 362/294, 373, 431, 800
See application file for complete search history.

(56) References Cited

U.S. PATENT DOCUMENTS

| | | | |
|---|---|---|---|
| 7,285,903 | B2 | 10/2007 | Cull et al. |
| 2011/0037412 | A1 | 2/2011 | Kim |
| 2011/0051420 | A1 | 3/2011 | Gill |

FOREIGN PATENT DOCUMENTS

| | | |
|---|---|---|
| JP | 2007-095647 | 4/2007 |
| JP | 2007-122936 | 5/2007 |
| KR | 10-2009-0093492 | 9/2009 |

*Primary Examiner* — Jason Moon Han
(74) *Attorney, Agent, or Firm* — Cantor Colburn LLP

(57) ABSTRACT

Provided is a light-emitting diode (LED) lighting device having a block assembly structure. The LED lighting device includes: a housing body whose bottom is open in which a number of assembly holes are respectively formed on assembly planes that are formed on a lateral surface of the housing body; a number of light source blocks including a number of LED modules, angle control portions each of which has a multistage slope plane on which each LED module is mounted, and a number of radiating fins that are provided at the rear surface of the multistage slope plane, in which the respective light source blocks are disposed and combined in the respective assembly holes of the housing body so as to realize a predetermined light distribution type; and a protective cover that covers the lower portion of the housing body.

15 Claims, 9 Drawing Sheets

(a) FIRST LIGHT DISTRIBUTION TYPE (b) SECOND LIGHT DISTRIBUTION TYPE (c) THIRD LIGHT DISTRIBUTION TYPE (d) FOURTH LIGHT DISTRIBUTION TYPE (e) FIFTH LIGHT DISTRIBUTION TYPE

LED LIGHTING APPARATUS HAVING BLOCK ASSEMBLING STRUCTURE

TECHNICAL FIELD

The present invention relates to an LED (Light-Emitting Diode) lighting device, and more particularly, to an LED lighting device having a block assembly structure in which a number of light source blocks including LEDs are conveniently assembled in a housing body to thus be easily designed and modified to have a variety of light distribution curves and the number of the light source blocks can be separated from one another to thus make it possible to be easily maintained and repaired.

BACKGROUND ART

Generally, streetlights are lighting devices used for lighting facilities that are installed along the streets for safety and security of road traffic, and thus appropriate kinds of the streetlights are used according to the installation location such as the highways, the major roads, commercial roads, and residential roads of urban district towns.

The lighting devices are equipped with a lamp housing on the inner surface of which a reflector is provided and that is installed on a streetlight pole, and a light source that is mounted in the inside of the lamp housing, respectively, to thus emit light. There are several different types of streetlight poles, which are a highway type of bending the end of each pole and suspending a lamp at the end of the pole, a bracket type of extending a branch horizontally at the end of each pole and suspending a lamp at the branch, and a capital type of suspending a lamp on top of each pole.

Moreover, high-pressure mercury lamps, fluorescent lamps, sodium vapor lamp or normal light bulbs, etc., are used as light sources. These streetlights emit white, yellow or blue light by predetermined color light sources. Of course, the streetlights may be selected according to an electric power efficiency or light intensity of the street lamps or the surrounding atmosphere.

Meanwhile, the streetlights are designed in the form of most efficiently illuminating roads considering a light distribution efficiency of distributing light on the roads at the time of installing the streetlights on the roads. In the case of using bulb type lamps, the light distribution is controlled by adjusting the angle of reflection of the reflector that is provided in the inner surface of the lamp housing so that roads are illuminated with an appropriate light distribution at the time of designing roadway lighting.

Generally, light distribution types that are chiefly used for roadway lighting are classified into first through fifth light distribution types as shown in FIG. 10. Except for some special roads, most of the roads are efficiently illuminated by chiefly using second through fifth light distribution types of light distribution curves.

However, when various lamps used as light sources in the conventional streetlights, that is, the high-pressure mercury lamps, fluorescent lamps, and sodium vapor lamp, etc., are initially manufactured, their brightness and diffusion ranges are determined. Thus, the conventional streetlights are so disadvantageous in the fact that users cannot artificially adjust the brightness and diffusion ranges. In addition, the conventional streetlights are very short in their life cycles and have shortcomings of causing more power consumption.

Considering the above-described problems, lighting devices using LEDs (Light-Emitting Diodes) as light sources are bing recently proposed. According to technological development, LEDs of low power consumption and high brightness light emission have been developed. Such LEDs are being gradually spread in use. The high brightness LEDs include lens portions that can be used by dispersing light emitted from LED chips and by dividing light emitting ranges into for example, 12-degree lens, 25-degree lens, 30-degree lens, 45-degree lens, and so on, when the LED chips are packaged so that the light emitted from the LED chips can illuminate a large area due to a strong straightforwardness of the light emitted from the LED chips.

Nevertheless, the LED lighting devices have the angles of illumination relatively smaller than bulb type light sources whose illumination angles are 360 degrees. Accordingly, the LED lighting devices generally illuminate roads by respectively mounting a number of LED modules on the lower surface of an upper plate of a housing and using a reflector that is provided in the inner side of the lateral surface of the housing.

The lighting devices include the number of the LED modules mounted on the lower surface of the upper plate, in order to secure an angle of view (that is called a cut-off-angle) so that pedestrians or drivers cannot see directly LED modules within a predetermined angle.

However, these high brightness LED streetlights directly interfere with walking or driving in the case that light from the light sources is directly illuminated on the pedestrians' or the drivers' eyes during walking or driving, to thereby cause accidents. Accordingly, it is essential to secure the angle of view or cut-off-angle.

However, the LEDs are semi-permanently long in life cycles when compared to the conventional lamps. Here, brightness of the LEDs is determined by combining a combination of multiple LEDs. Accordingly, in the case that light distribution is formed through a reflector, a light distribution area is small and a brightness degree is low. Further, there is a limitation in realizing a light distribution efficiency of efficiently illuminating roads, that is, the first through fifth light distribution types of the light distribution techniques. Thus, the LED lighting devices provide brightness only depending on the reflector, while excluding the ideal arrangement at the time of manufacturing. As a result, the LED lighting devices may cause inefficient illumination on the roads and thus are not being widely used.

Moreover, it is difficult to efficiently dissipate heat radiating from the number of the LEDs. Thus, because of the heat, a luminous efficiency does not only degrade but also parts of the LEDs are damaged.

In addition, the streetlights using the conventional LED lamps or conventional non-LED lamps have used transparent protective covers in order to protect the lamps that are installed within the housing. However, these protective covers are formed into concave types that mainly protrude to the external side of the housing. As a result, the streetlights are protruded up and down in protruding shape at the state where the housing and the protective cover have been combined, to thereby cause the overall volume to become large and have the difficulty of storage and transportation.

DISCLOSURE

Technical Problem

Accordingly, to solve the above conventional problems or defects, it is an object of the present invention to provide an LED (Light-Emitting Diode) lighting device having a block assembly structure that enables a number of light source blocks to be individually assembled on each of assembly planes of the LED lighting device to thereby make a variety of light distribution characteristics easily designed and modified.

It is another object of the present invention to provide an LED (Light-Emitting Diode) lighting device having a block assembly structure that enables a number of light source blocks whose illumination angles and brightness differ from each other to be selectively arranged on each of assembly planes of a housing body of the LED lighting device, in a manner that a desired light distribution characteristic is realized by using the number of the light source blocks including a number of LED modules as point light sources.

It is still another object of the present invention to provide an LED (Light-Emitting Diode) lighting device having a block assembly structure in which a number of light source blocks where a number of LED modules are mounted are assembled into a number of assembly holes of a housing body of the LED lighting device, to thus achieve a desired angle of illumination, and each light source block can be individually separated, to thereby make it easy to maintain and repair the LED lighting device.

It is yet another object of the present invention to provide an LED (Light-Emitting Diode) lighting device having a block assembly structure in which a number of light source blocks where a number of LED modules are mounted are integrally formed with radiating fins to thus minimize an interface between the LED modules and the radiating fins and to thereby obtain an excellent heat transfer efficiency from the LED modules to the radiating fins and maximize a heat radiating effect.

Technical Solution

To accomplish the above and other objects of the present invention, there is provided a light-emitting diode (LED) lighting device comprising:

a housing body whose bottom is open in which a number of assembly holes are respectively formed on assembly planes that are formed on a lateral surface of the housing body;

a number of light source blocks including a number of LED modules, angle control portions each of which has a multistage slope plane on which each LED module is mounted, and a number of radiating fins that are provided at the rear surface of the multistage slope plane, in which the respective light source blocks are disposed and combined in the respective assembly holes of the housing body so as to realize a predetermined light distribution type; and a protective cover that covers the lower portion of the housing body.

Preferably but not necessarily, the light source blocks further comprise individual covers, respectively, to protect the LED modules.

Preferably but not necessarily, a convex portion that comes into the inner side of the housing body as it goes toward the center of the protective cover is formed on the protective cover in order to prevent total reflection of the light irradiated from the LED module.

Preferably but not necessarily, the LED lighting device further comprises a retaining ring that fixedly supports the protective cover on the housing, and a packing that is combined along the outer circumference of the protective cover in order to seal in a water-tight manner between the protective cover and the housing, wherein the packing comprises a number of sealing protrusions along the outer circumference of the protective cover.

According to another aspect of the present invention, there is provided a light-emitting diode (LED) lighting device comprising:

a housing body whose bottom is open in which a number of assembly holes are respectively formed on assembly planes that are formed on a lateral surface of the housing body;

a number of light source blocks including a number of LED modules, angle control portions each of which has a multistage slope plane on which each LED module is mounted, and a number of radiating fins that are provided at the rear surface of the multistage slope plane, in which the respective light source blocks are disposed and combined in the respective assembly holes of the housing body so as to realize a predetermined light distribution type; and a number of individual covers that cover the respective light source blocks.

Preferably but not necessarily, the housing body is formed of twelve assembly planes in a dodecagonal shape, in which assembly holes are respectively formed on the assembly planes, and coupling pieces are extended from coupling holes that are formed in the light source blocks are penetrated through and combined with the light source blocks.

Preferably but not necessarily, a packing is provided on an interface that is formed when the light source block is combined on the housing body.

Preferably but not necessarily, the LED lighting device further comprises a printed circuit board that is mounted at a gap spaced from the inner-upper surface of the housing body and is connected with a connector that is formed in the light source block, to thereby apply electric power to the LED modules, wherein the printed circuit board is a double-sided printed circuit board on the upper surface of which electronic components are mounted and on the lower surface of which an amber LED module is mounted.

Preferably but not necessarily, power devices mounted on the printed circuit board are supported by spacers that are placed between the power devices and the upper surface of the printed circuit board and are in contact with the inner-upper surface of the housing body, to thus radiate heat.

Preferably but not necessarily, the light source blocks have an identical structure, respectively, and an orientation direction of the angle control portion in each light source block is set in a direction seceded from the central axis of the housing body.

Advantageous Effects

As described above, according to the present invention, a number of light source blocks having a block structure that each block is equipped with an LED module are assembled with a housing body, to thus make it easy to do assembly, separation and design changes, and angle control portions that provide a variety of angles are integrally formed on the light source blocks and are assembled on respectively different circumferential surfaces of the housing body having respectively different illuminating angles, to thereby implement a desired light distribution type of a lighting device.

In addition, the respective light source blocks on the external portion of which radiating fins are integrally formed are assembled into a number of assembly holes of the housing body, to thus minimize an interface and to thereby obtain an excellent heat transfer efficiency from the LED modules to the radiating fins and maximize a radiating effect.

In addition, according to the present invention, a number of light source blocks are formed integrally with a number of LEDs and the radiating fins, and are assembled on the housing body, to thereby make it easy to separate and replace LEDs during maintenance and repair of the LEDs.

Furthermore, when the number of the light source blocks are respectively combined into the assembly holes of the housing body, male-connectors that apply electric power for driving LEDs to the light source blocks are directly connected with female-connectors that are mounted on the printed circuit board (PCB), to thus eliminate connection of a number of wires and assembly of the housing body with the number of the light source blocks, and to thereby enhance an assembly productivity.

BEST MODE

Hereinbelow, a light-emitting diode (LED) lighting device according to a preferred embodiment of the present invention will be described in detail with reference to the accompanying drawings.

In this embodiment, an LED lighting device having a block assembly structure 100 applied to a streetlight will be described as an example. However, the LED lighting device according to the present invention 100 can be applied to illumination for indoor and outdoor parking lots, indoors, tunnels, etc., as well as streetlights.

Figure 1:
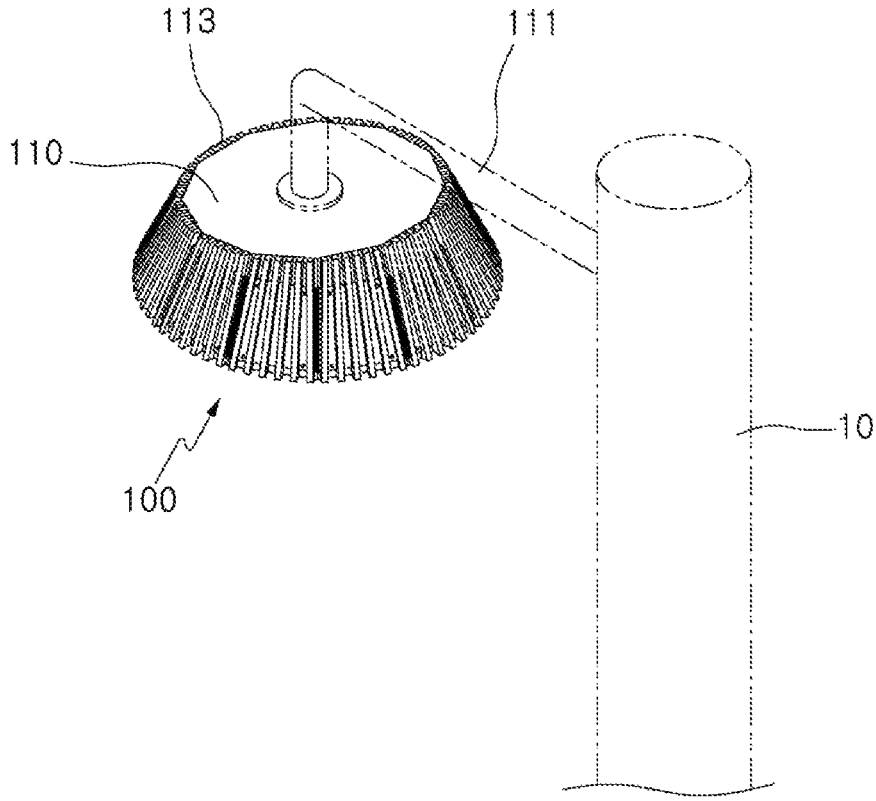
FIG. 1 is a perspective view illustrating a LED lighting device according to an embodiment of the present invention.

Referring to FIG. 1, the LED lighting device 100 can be installed at and fixed to an L-shaped suspension bar 111 extended from an upper portion of an electric light pole 10. For example, the LED lighting device 100 is configured to have a number of radiating fins 113 are extended and arranged in the up-and-down direction along twelve outer faces of a housing body 110 of a dodecagonal shape.

The lower part of the housing body 110 is open for illumination of light, and is made of metal with excellent thermal conductivity, for example, aluminum or aluminum alloy, and thus can be made in an extrusion or die-casting method considering heat transfer and stiffness. The end of the L-shaped suspension bar 111 is fixed at the upper portion of the housing body 110. The L-shaped suspension bar 111 includes a certain spatial portion (not shown) through which certain electric wires that are withdrawn from the inside of the housing body 110 pass. The L-shaped suspension bar 111 can be modified in various forms depending on application fields where the LED lighting device 100 is applied.

Referring to an exploded perspective view of FIG. 2, the LED lighting device 100 includes: a housing body 110 of a dodecagonal shape; a number of light source blocks 110*a*, 110*b*, 110*c*, . . . in which an LED module 140 mounted on an angle control portion 130 is integrally disposed in each light source block; a printed circuit board (hereinafter, referred to as PCB) 150; a packing 170; a protective cover 160; and a retaining ring 180.

Here, the angle control portions 130 with respectively different sloped faces are formed on the inner surfaces of the number of the light source blocks 110*a*, 110*b*, 110*c*, . . . that are fitted into and assembled with the twelve faces of the housing body 110. The number of the LED modules 140 are mounted on the respective angle control portions 130, and radiating fins 113 are formed on the outer surfaces of the light source blocks 110*a*, 110*b*, 110*c*, . . . .

As described above, the light source blocks 110*a*, 110*b*, 110*c* . . . are integrally formed with the angle control portions 130 and the radiating fins 113. Interfaces that are formed between the LED modules 140 and the radiating fins 113 are minimized. As a result, heat from the LED modules 143 is transferred directly to the radiating fins 113 to thereby maximize a heat radiation effect.

Figure 3:
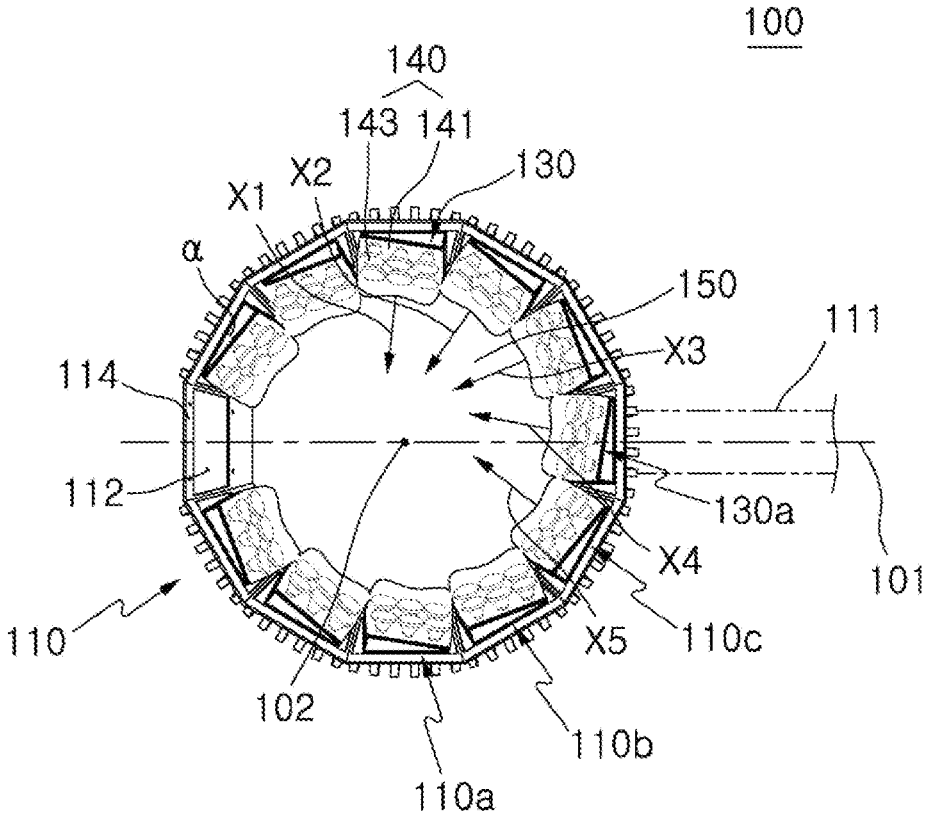
FIG. 3 is a bottom view illustrating the LED lighting device shown in FIG. 1.
Figure 4:
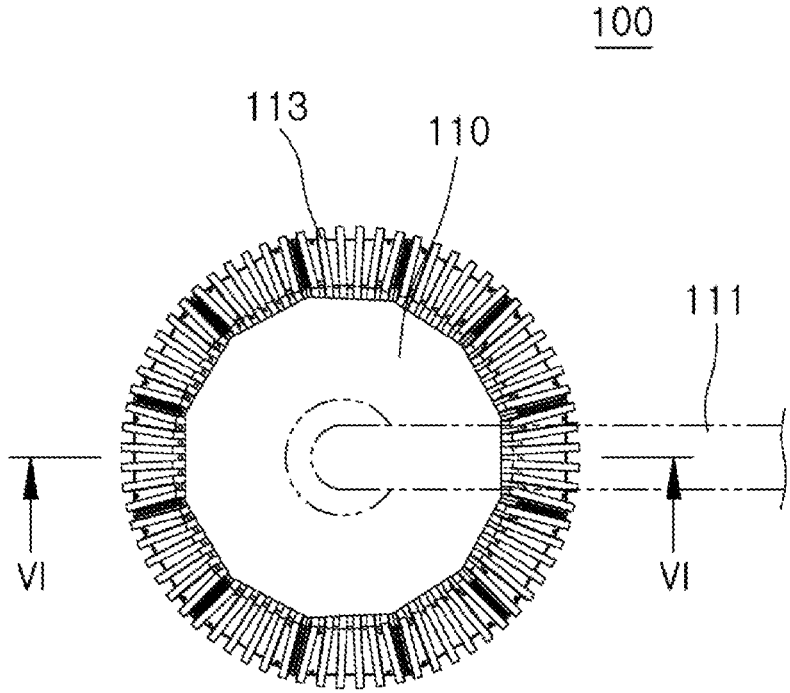
FIG. 4 is a plan view illustrating the LED lighting device shown in FIG. 1.

Referring to FIGS. 3 and 4, the housing body 110 includes an accommodation groove whose lower portion is opened and that is formed of twelve faces in which the diameter of the accommodation groove increases from the top to the bottom, that is, the accommodation groove is increasingly widened downwards. Assembly holes 112 are respectively formed in assembly planes 114 on which the twelve light source blocks 110*a*, 110*b*, 110*c*, . . . are assembled in the inner twelve faces placed in the inside of the housing body 110 of the accommodation groove. The shape of the housing body 110 will be described in detail with reference to FIG. 5.

Referring to FIG. 3, the eleven light source blocks 110*a*, 110*b*, 110*c*, . . . are fitted into and assembled with the assembly holes 112 in the inner side of the housing body 110, but the other one light source block is not fitted into and assembled with the remaining one assembly hole 112.

The light source blocks 110*a*, 110*b*, 110*c*, . . . have an identical structure, and orientation directions X1-X5 of the respective angle control portions 130 that are formed in the respective light source blocks 110*a*, 110*b*, 110*c*, . . . are set in directions seceded from the central axis 102 of the housing body 110. Here, the respective angle control portions 130 of the light source blocks 110*a*, 110*b*, 110*c*, . . . are made to determine size of an illumination area depending on an inclination angle $\alpha$ with respect to the housing body 110.

As shown in FIG. 3, all the orientation directions X1-X5 of the respective angle control portions 130 are set in directions seceded from the central axis 102 of the housing body 110, but one or some of the orientation directions X1-X5 may be set to face the central axis 102 thereof, depending on a light distribution curve of a lighting device to be implemented. To do this, the inclination angles $\alpha$ of the respective angle control portions 130 may be adjusted and arranged differently from one another.

Figure 10:
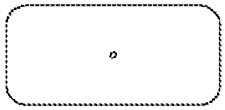
FIG. 10 illustrates several light distribution types of light distribution curves.
Figure 10:
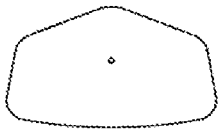
Figure 10:
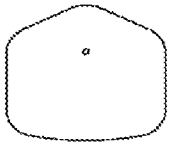
Figure 10:
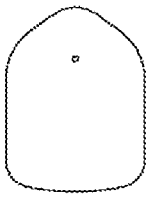
Figure 10:
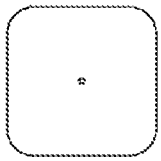

In more detail, referring to FIGS. 3 and 10, for example, in the case that a fourth light distribution type of a lighting device is implemented, the orientation directions X1, X2, X3, X4, and X5 are set to make most of the angle control portions 130 that are placed at the left and right sides based on a reference line 101 extending from the suspension bar 111 face the front-side assembly holes 112, respectively. Alternatively, in the case that a fifth light distribution type of a lighting device having a square shape is implemented, the orientation directions X1, X2, X3, X4, and X5 of all the angle control portions 130 are set to face the central axis 102 of the housing body 110.

Figure 7:
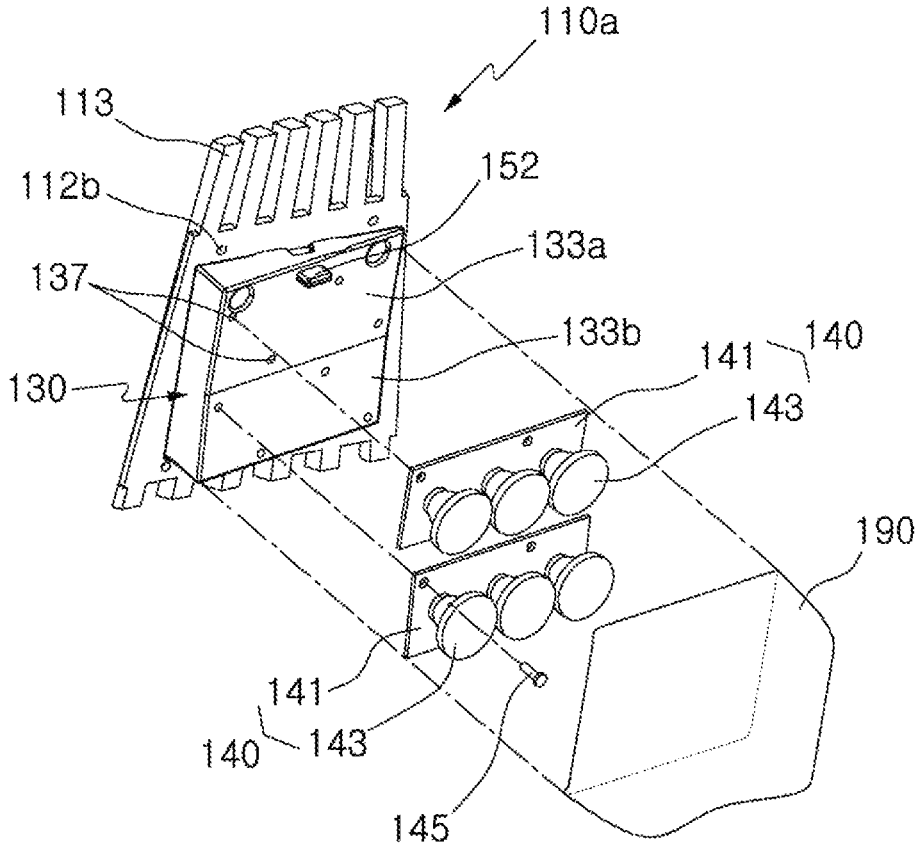
FIG. 7 is an exploded perspective view illustrating a light source block according to the present invention.

Meanwhile, referring to FIG. 7, the respective angle control portions 130 are made with a multi-stage structure having one or more slope planes 133*a* and 133*b* on which LED modules 140 are mounted according to a light distribution curve of a lighting device to be implemented.

For example, referring to FIGS. 3 and 10, in the case that a third or fourth light distribution type of a lighting device is implemented, the illumination directions of the front-side assembly holes 112 face rearwards. Thus, in the case that the angle control portions 130 are inserted, a single-stage slope plane is provided. Meanwhile, since the illumination directions face frontwards in the case of the angle control portions 130 opposing the front-side assembly holes 112, a three-stage slope plane is provided. In this manner, each LED module 140 is mounted on each slope plane.

In addition, two or more stage slope planes 133*a* and 133*b* are provided in the angle control portions that are located at the left and right sides of the rear-side angle control portion 130*a* in which LED modules 140 are mounted on the slope planes 133*a* and 133*b*, respectively. Meanwhile, a single-stage slope plane is disposed in the angle control portions that are located at the left and right sides of the front-side assembly hole 112 in which an LED module 140 may be mounted on the slope plane or no LED module 140 may be mounted thereon.

As described above, the LED lighting device according to the present invention can achieve a variety of light distribution curves by a number of angle control portions 130 on which a number of LED modules 140 are mounted and that are block-assembled into assembly holes 112 of a housing body 110, and the number of the LED modules 140 that are mounted on the respective angle control portions 130 and that can be set as respectively different illumination angles and brightness.

Referring to FIG. 4, radiating fins 113 of twelve faces are radially protrudingly formed on the outer side of the housing body 110.

As shown in FIG. 4, since the upper surface of the housing body 110 has a shape of a dodecagon, the horizontally cross-sectional shape is a dodecagon. However, the horizontally cross-sectional shape may be formed of various polygonal shapes other than a circular shape, an oval shape, a square shape, a rectangular shape, or a dodecagonal shape if the external shapes of the radiating fins 113 or the housing body 110 are changed.

Figure 5:
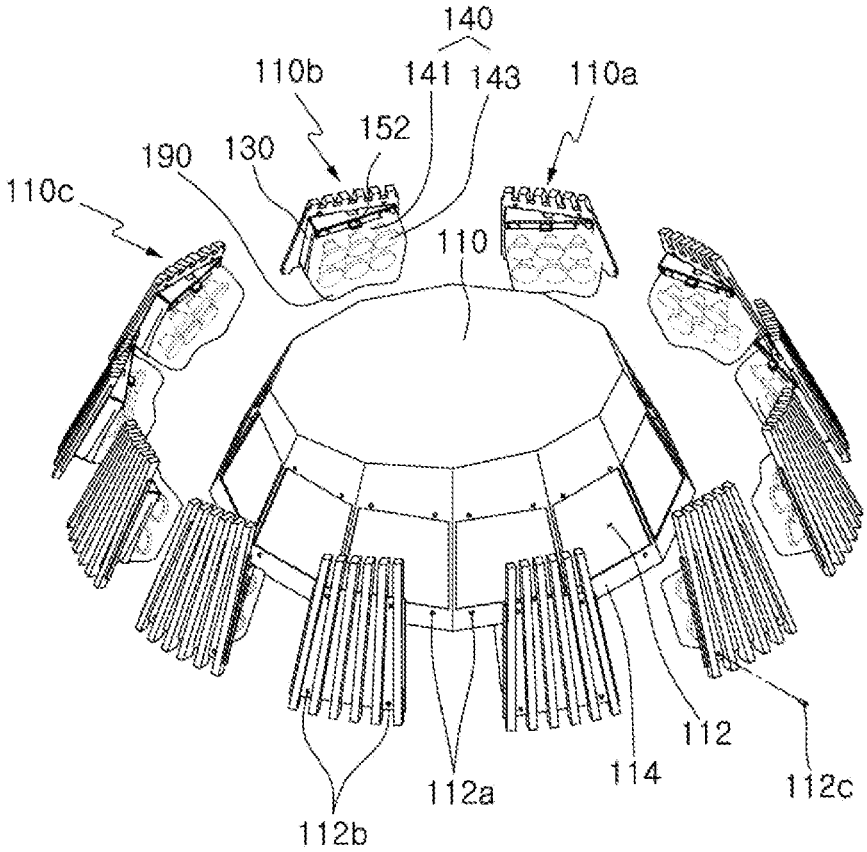
FIG. 5 is a perspective view for explaining a housing body and light source blocks of the LED lighting device shown in FIG. 1.

Referring to FIG. 5, the housing body 110 is extended downwards through the twelve assembly planes 114 as the dodecagonal shape. An assembly hole 112 is formed on each assembly plane 114 in which the light source blocks 110*a*, 110*b*, 110*c*, . . . are assembled into the assembly holes 112, respectively. In addition, two coupling holes 112*a* are formed in the upper and lower portions of each assembly hole 112. The light source blocks 110*a*, 110*b*, 110*c*, . . . are assembled with the housing body 110 in which the coupling holes 112*a* of each light source block and the coupling holes 112*b* of the housing body 110 are coupled by coupling pieces 112*c*. In other words, the coupling holes 112*b* of each of the light source blocks 110*a*, 110*b*, 110*c*, . . . and the coupling holes 112*a* of the housing body 110 have an identical diameter and are completely assembled by the coupling pieces 112*c* that couple the two coupling holes 112*a* and 112*b*.

Here, each of the light source blocks 110*a*, 110*b*, 110*c*, . . . includes LED modules 140 respectively made of a number of LEDs 143 respectively mounted on metal PCBs 141 placed on top of each angle control portion 130, and has an individual cover 190 to protect the LED modules 140.

In addition, each of the light source blocks 110*a*, 110*b*, 110*c*, . . . includes a male connector 152 that connects a printed circuit board (PCB) 150 with the metal PCBs 141 in which the male connector 152 is connected to a female connector (not shown) of the PCB 150.

Figure 8:
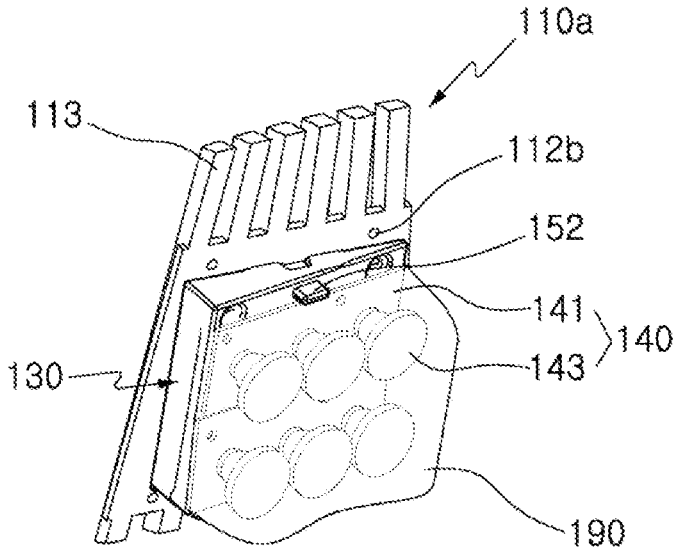
FIG. 8 is a perspective view of the light source block of FIG. 7.

FIG. 7 is an exploded perspective view of the light source block 110*a* that is assembled with the housing body 110, and FIG. 8 is a perspective view of the light source block 110*a*.

Referring to 7 and 8, the light source block 110*a* according to the present embodiment includes a number of radiating fins 113 formed on the outside thereof and two LED modules 140 that are mounted on the angle control portion 130 having two slope planes. Here, the angle control portion 130 integrally formed on the light source block 110*a* has the two-stage slope planes 133*a* and 133*b* having two different angles.

The angle control portion 130 may be made into a cube having a substantially rectangular or square cross-sectional shape according to the number of the LED modules 140 that are mounted on the front portion thereof.

The slope planes 133*a* and 133*b* on which a number of the LED modules 140 are mounted at certain angles are formed on the front portion of the angle control portion 130, in order to ensure the LED lighting device 100 to illuminate with a desired light distribution characteristic. In this case, the slope planes 133*a* and 133*b* may be accomplished of at least one or more in number.

Here, the LED module 140 includes a substantially rectangular metal PCB 141 and a number of LEDs 143 that are mounted on the outer surface of the metal PCB 141. The metal PCB 141 is preferably made of a plate material with an excellent thermal conductivity such as aluminum, copper, iron or alloy thereof. The metal PCBs 141 are fixed on the slope planes 133*a* and 133*b* of the angle control portion 130 through certain fixing pieces 145.

In this case, throughholes 147 are formed on the metal PCBs 141, in which the fixing pieces 145 pass through the throughholes 147, and connection holes 137 through which the fixing pieces 145 are connected are formed on the slope planes 133*a* and 133*b*. Thereafter, an individual cover 190 may be provided to protect the LED modules 140, and a packing 154 may be combined in order to make a sealing performance at an interface between the light source block 110*a* and the housing body 110 when the light source block 110*a* is assembled with the housing body 110.

The angle control portion 130 is made of the same metallic material as that of the housing body 110, and is preferably made of metal, for example, aluminum or aluminum alloy in an extrusion or die-casting way by considering the heat transfer and stiffness.

A sealing structure of the housing body 110 that is formed as described above will be described with reference to FIGS. 2 and 6.

Figure 2:
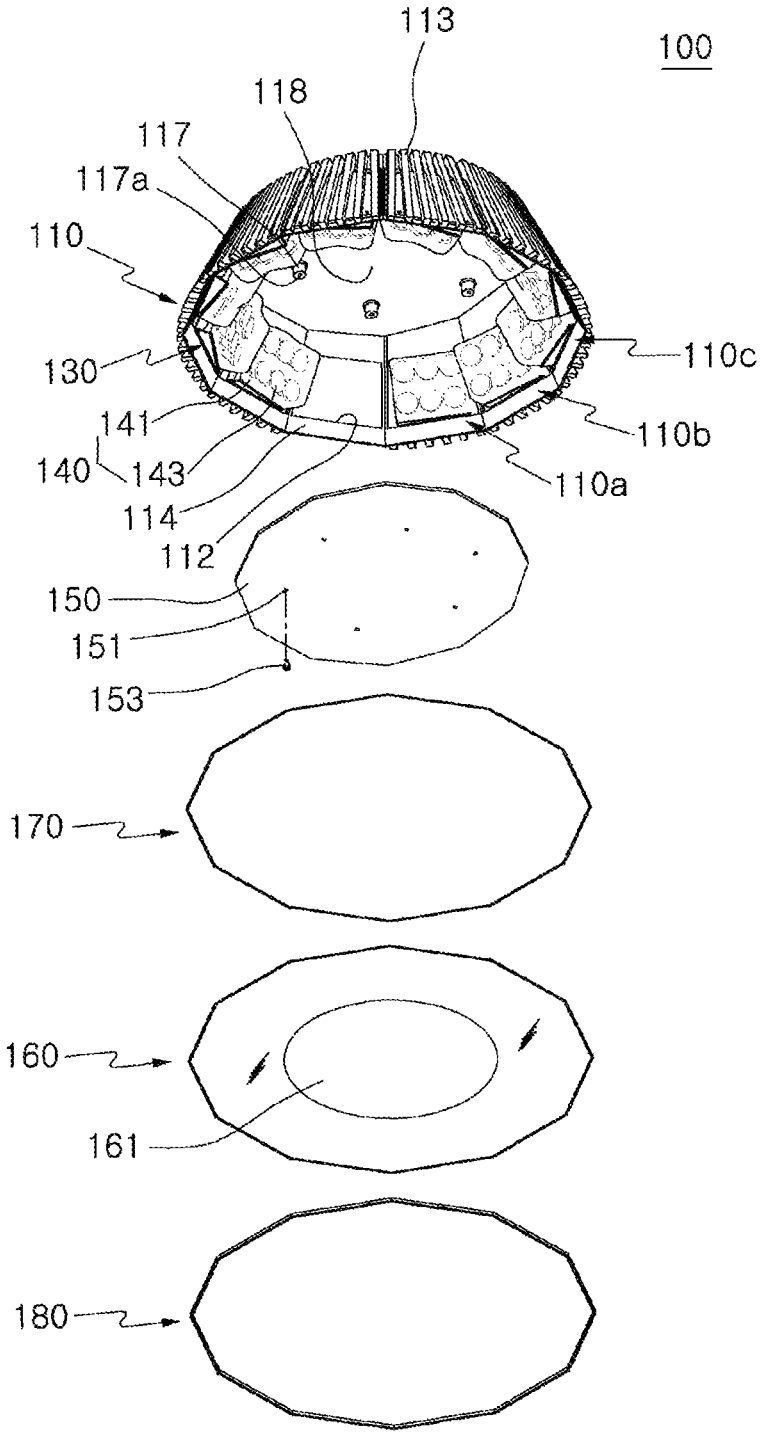
FIG. 2 is an exploded perspective view illustrating the LED lighting device shown in FIG. 1.
Figure 6:
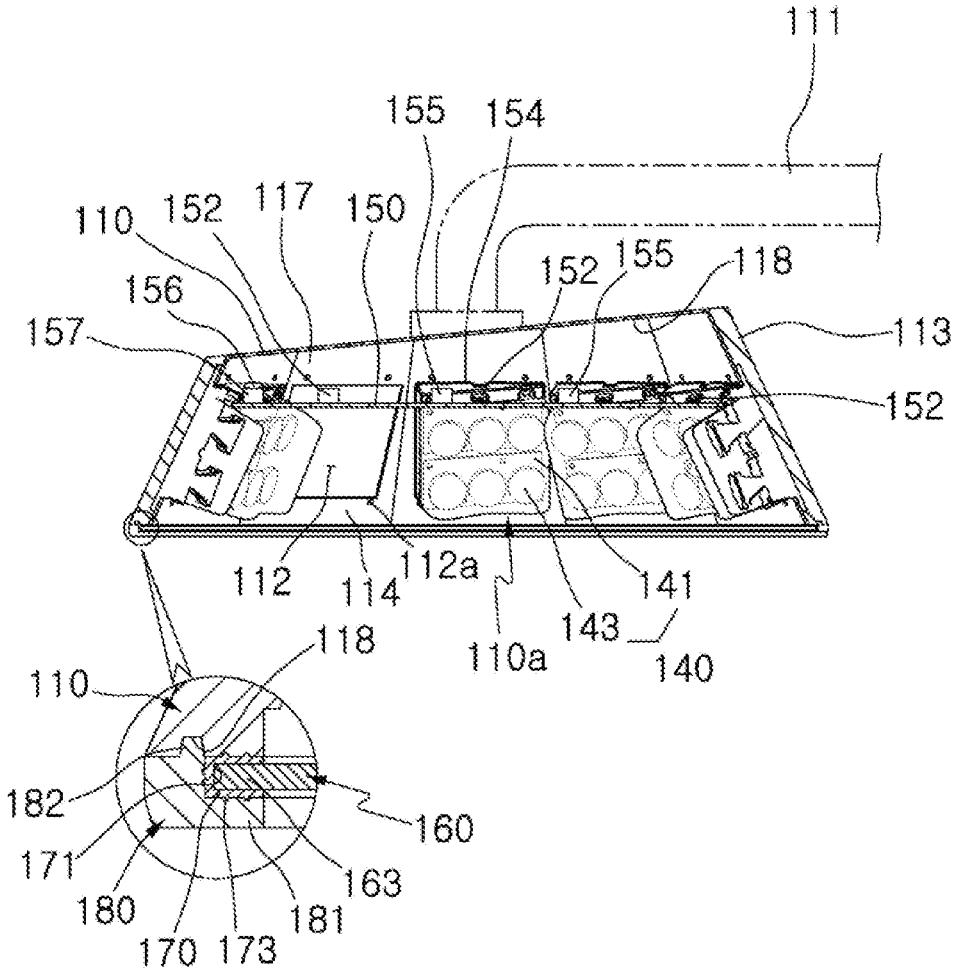
FIG. 6 is a cross-sectional view cut along the line VI-VI shown in FIG. 4.

Referring to FIGS. 2 and 6, a number of fixing protrusions 117 for fixing a printed circuit board (PCB) 150 on which electronic components 155 are mounted are formed on the inner-upper surface 118 of the housing body 110, and connection grooves 117*a* into which a number of fixing pieces 153 are connected are formed in the fixing protrusions 117, respectively. In this case, the PCB 150 includes a number of throughholes 151 that are formed on at positions that correspond to the fixing protrusions 117, respectively, and is fixed to the fixing protrusions 117 by the fixing pieces 153. Here, the fixing protrusions 117 play a role of spacers to allow a predetermined spacing between the PCB 150 and the inner-upper surface 118 of the housing body 110, to thereby prevent the pattern of the PCB 150 from being damaged or to avoid the electronic components 155 that are mounted on the PCB 150 from malfunctioning by the high-temperature heat that are generated from the LED modules 140 and then transferred to the housing body 110.

Meanwhile, the PCB 150 may be formed into a double side substrate made of fiberglass reinforced epoxy laminates of FR4 (Flame Retardant Class 4), and is provided with an electric power circuit adopting a switching mode power supply (SMPS) method and a constant-current/constant-voltage circuit. In this case, an electric power device 156 mounted on the PCB 150 is in contact with the inner-upper surface 118 of the housing body 110, in order to radiate heat at a state of being supported by a sponge 157. In addition, when a number of LEDs are combined in the PCB 150 in order to implement colors of the LED lighting device 100, amber LEDs (not shown) located on the bottom of the PCB 150 are combined with a number of the LED modules 140 that are mounted at the lateral surfaces of the accommodation grooves of the housing body 110, in order to reveal the orange color in addition to the cool white and warm white colors. After a light source block 110*a* has been completely assembled into the assembly holes 112 of the housing body 110, a sealing performance can be enhanced by the packing 154.

In the case of the LED lighting device 100, each of the light source blocks 110*a*, 110*b*, 110*c*, . . . is provided with an individual cover 190 and simultaneously provided with the protective cover 160, the packing 170, and the retaining ring 180 in order to seal the front opening portion as shown in FIG. 6. The protective cover 160, the packing 170, and the retaining ring 180 will be described below.

Figure 9:
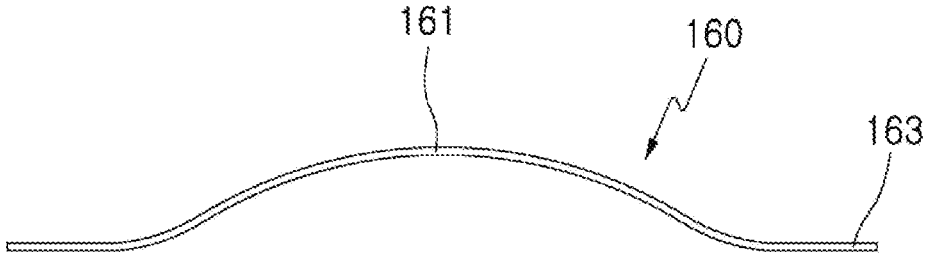
FIG. 9 is a cross-sectional view showing a protective cover according to the present invention.

The protective cover 160 is installed in the opening portion of the housing body 110, to thereby prevent foreign matters or moisture from entering into the housing body 110, and is made of a transparent or translucent glass or synthetic resin material. As shown in FIG. 9, the protective cover 160 includes a convex portion 161 that smoothly protrudes upwards as it goes roughly towards the central portion thereof. The curvature of the convex portion 161 is preferably established by considering total reflection and transmission of light emitted from the LEDs 143. As described above, in the case that the protective cover 160 includes the convex portion 161, the transmission of light can be enhanced by 6% or higher in comparison with the planar cover.

In addition, when the protective cover 160 is mounted in the housing body 110, the convex portion 161 comes into the inside of the housing body 110. Accordingly, the volume of the lighting device according to the present invention can be reduced compared to the case of the conventional lighting devices with the protective covers that protrude outwards.

The packing 170 is made of a ring-shaped rubber material. An insertion groove 171 into which the outer circumferential end 163 of the protective cover 160 are inserted is formed along the inner circumference of the packing 170. In addition, a number of sealing protrusions 173 are formed along the outer circumference of the packing 170. The sealing protrusions 173 are made to be in contact with the housing body 110 and retaining ring 180 to thereby improve a sealing performance.

The retaining ring 180 is made into a ring-shaped form in order to fix the protective cover 160 to the housing body 110, and thus has a shape roughly corresponding to the bottom of the housing body 110. The retaining ring 180 is preferably formed of aluminum as in the case of the housing body 110. The retaining ring 180 includes a coupling protrusion 182 that is coupled with a coupling groove 118 that is formed along the bottom of the housing body 110 in order to improve an adhesion strength with respect to the housing body 110, and is fixed to the housing body 110 by a number of fixing pieces 185. Accordingly, the retaining ring 180 plays a role of pressing and fixing the packing 170 and the protective cover 160 to the housing body 110 by a support holder 181. In this case, throughholes 183 through the fixing pieces 185 pass are formed in the retaining ring 180, and a number of coupling holes 119 into which the fixing pieces 185 are coupled are formed in the housing body 110, respectively.

The LED lighting device 100 according to the above-described embodiment of the present invention can be implemented into a variety of light distribution types, for example, second through fifth light distribution types, by transforming the shape of a combination of various types of angle control portions 130 on which the LED modules 140 are installed in the inside of the housing body 110, to thereby heighten a higher degree of freedom when designing lighting devices for use of various kinds of purposes.

In addition, it is possible to assemble a number of the light source blocks 110*a*, 110*b*, 110*c*, . . . on which a number of the LED modules 140 are mounted into a number of the assembly holes 112 of the housing body 110 and individually separate each of the light source blocks 110*a*, 110*b*, 110*c*, . . . from each of the assembly holes 112, to thus make it easy to maintain and repair the lighting device. Further, interfaces from LEDs to radiation fins can be minimized to thus obtain an excellent heat transfer efficiency and maximize a heat radiation effect.

In the above-described embodiments, each of the light source blocks 110*a*, 110*b*, 110*c*, . . . includes the individual cover 190 and simultaneously the protective cover 160 for sealing the front opening portion, as shown in FIG. 6, but each of the light source blocks 110*a*, 110*b*, 110*c*, . . . may include only the individual cover 190 without sealing the front opening portion. Alternatively, it is possible to seal only the front opening portion with the protective cover 160 and without using the individual cover 190.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

INDUSTRIAL APPLICABILITY

As described above, the lighting devices according to the present invention can be applied to a variety of light distribution types of streetlights for lighting roads, indoor lights, or lights for parking lots.

The invention claimed is:

1. A light-emitting diode (LED) lighting device comprising:

a housing body whose bottom is open in which a number of assembly holes are respectively formed on assembly planes that are formed on a lateral surface of the housing body;

a number of light sources blocks each including a number of LED modules, angle control portions each of which has a multistage slope plane on which each LED module is mounted, and a number of radiating fins that are provided at the rear surface of the multistage slope plane, in which the respective light source blocks are disposed and combined in the respective assembly holes of the housing body so as to realize a predetermined light distribution type; and a protective cover that covers the lower portion of the housing body.

2. The light-emitting diode (LED) lighting device according to claim 1, further comprising a protective cover that covers the lower portion of the housing body.

3. The light-emitting diode (LED) lighting device according to claim 2, wherein a convex portion that comes into the inner side of the housing body as it goes toward the center of the protective cover is formed on the protective cover in order to prevent total reflection of the light irradiated from the LED module.

4. The light-emitting diode (LED) lighting device according to claim 2, further comprising: a retaining ring that fixedly supports the protective cover on the housing, and a packing that is combined along the outer circumference of the protective cover in order to seal in a water-tight manner between the protective cover and the housing, wherein the packing comprises a number of sealing protrusions along the outer circumference of the protective cover.

5. The light-emitting diode (LED) lighting device according to claim 1, wherein the housing body has an accommodating groove that is increasingly widened downwards, and whose horizontally cross-sectional shape is polygonal, circular, or oval.

6. The light-emitting diode (LED) lighting device according to claim 5, wherein the housing body is formed of a dodecagon in the horizontally cross-sectional shape, and has twelve assembly planes.

7. The light-emitting diode (LED) lighting device according to claim 1, wherein the number of the radiating fins are integrally formed on the backside of the multistage slope plane.

8. The light-emitting diode (LED) lighting device according to claim 1, wherein a packing is provided on an interface that is formed when the light source block is combined on the housing body.

9. The light-emitting diode (LED) lighting device according to claim 1, wherein the light source block further comprises an individual cover to protect the LED modules.

10. The light-emitting diode (LED) lighting device according to claim 1, further comprising a printed circuit board that is mounted at a gap spaced from the inner-upper surface of the housing body and is connected with a connector that is formed in the light source block, to thereby apply electric power to the LED modules, wherein the printed circuit board is a double-sided printed circuit board on the upper surface of which electronic components are mounted and on the lower surface of which an amber LED module is mounted.

11. The light-emitting diode (LED) lighting device according to claim 10, wherein power devices mounted on the printed circuit board are supported by spacers that are placed between the power devices and the upper surface of the printed circuit board and are in contact with the inner-upper surface of the housing body, to thus radiate heat.

12. The light-emitting diode (LED) lighting device according to claim 1, wherein the number of the light source blocks have coupling holes that are coupled with the assembly holes of the housing body.

13. The light-emitting diode (LED) lighting device according to claim 1, wherein an orientation direction of each angle control portion is set in a direction seceded from the central axis of the housing body.

14. The light-emitting diode (LED) lighting device according to claim 1, wherein the number of the LED modules are set in respectively different angles and brightness in order to implement a predetermined light distribution curve, to thus illuminate light.

15. A light-emitting diode (LED) lighting device comprising:

a housing body whose bottom is open in which a number of assembly holes are respectively formed on assembly planes that are formed on a lateral surface of the housing body;

a number of light sources blocks each including a number of LED modules, angle control portions each of which has a multistage slope plane on which each LED module is mounted, and a number of radiating fins that are provided at the rear surface of the multistage slope plane, in which the respective light source blocks are disposed and combined in the respective assembly holes of the housing body so as to realize a predetermined light distribution type; and a number of individual covers that cover the respective light source blocks.

* * * * *